US005097993A

United States Patent [19]

Davis

[11] Patent Number: 5,097,993

[45] Date of Patent: Mar. 24, 1992

[54] POUCH PACKAGING MACHINE FILL TUBE AND PLUNGER ROD ASSEMBLY

[75] Inventor: Steven D. Davis, Yuciapa. Calif.

[73] Assignee: W.A. Lane, Inc., San Bernardino, Calif.

[21] Appl. No.: 618,487

[22] Filed: Nov. 27, 1990

[51] Int. Cl.[5] ..... B67D 3/00

[52] U.S. Cl. ..... 222/509; 222/485; 222/504; 222/518; 222/559

[58] Field of Search ..... 222/504, 509, 510, 518, 222/559, 485, 487, 309; 141/266, 284

[56] References Cited

U.S. PATENT DOCUMENTS

| | | | |
|---|---|---|---|
| 160,720 | 3/1875 | Ryberg | 222/485 X |
| 339,709 | 4/1886 | Stone | 222/485 X |
| 485,942 | 11/1892 | Jackson | 222/485 X |
| 679,064 | 7/1901 | Stone | 222/485 |
| 921,874 | 5/1909 | McVitie et al. | 222/485 X |
| 1,379,249 | 5/1921 | Chelius | 222/485 |
| 1,728,142 | 9/1929 | Vartabedian | 222/509 |
| 2,688,423 | 9/1954 | Davis | 222/504 X |
| 2,870,944 | 1/1959 | Campbell | 222/509 |
| 3,239,106 | 3/1966 | Sipusic | 222/487 X |
| 3,343,721 | 9/1967 | Paley | 222/504 X |
| 4,066,188 | 1/1978 | Scholl et al. | 222/504 X |
| 4,129,232 | 12/1978 | Coupar | 222/510 X |
| 4,194,576 | 4/1979 | Vinson et al. | 222/509 X |
| 4,363,429 | 12/1982 | Schindler | 222/571 X |
| 4,566,249 | 1/1986 | Schwerdtel et al. | 53/55 |
| 4,711,277 | 12/1987 | Clish | 141/128 X |

*Primary Examiner*—Kevin P. Shaver
*Attorney, Agent, or Firm*—Herb Boswell

[57] ABSTRACT

A fill tube has a hollow interior with a product inlet orifice, a product discharge orifice and a fill rod orifice connected to the interior. A plunger rod having ends is mounted through the fill rod orifice such that its first end is located within the hollow interior of the tube adjacent the product discharge orifice. The plunger rod has a valve member on this end that is tear drop in shape and is sized to fit into and seal against the inside of the discharge orifice. A plurality of fill tubes and plungers can be mounted on a packaging machine in conjunction with a prime mover and a moving member that is operated by the prime mover. Each of the plungers are connected to the moving member so as to be moved within their fill tubes in conjunction with movement of the moving member imparted thereto by the prime mover.

20 Claims, 3 Drawing Sheets

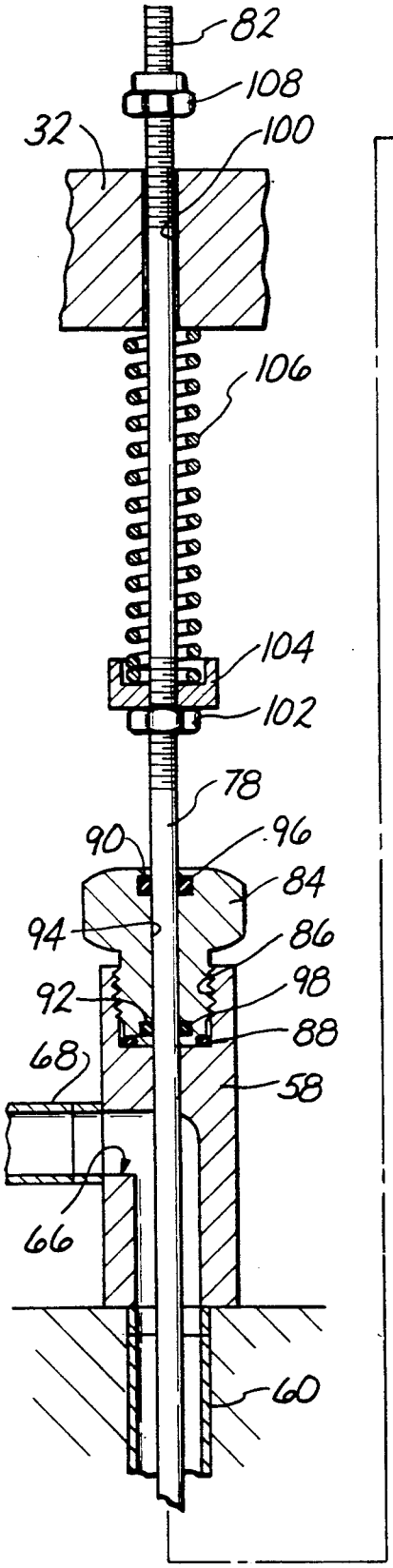
Fig. 3
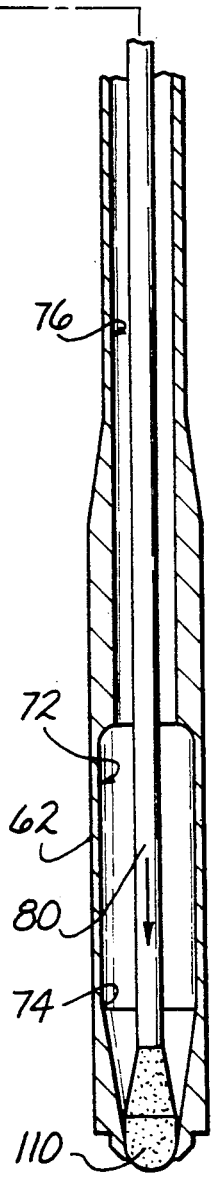
Fig. 4
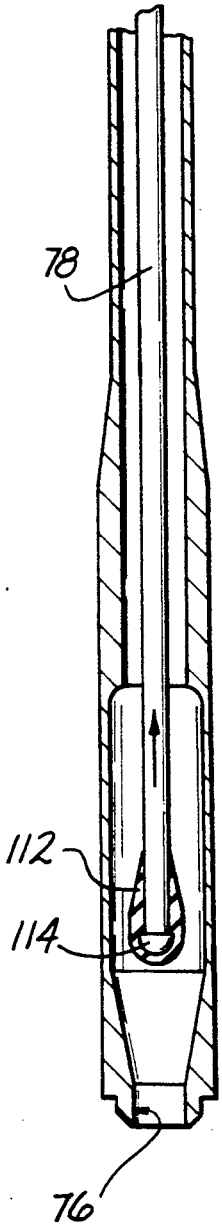

POUCH PACKAGING MACHINE FILL TUBE AND PLUNGER ROD ASSEMBLY

BACKGROUND OF THE INVENTION

This invention is directed to a fill tube and plunger rod and to assemblies of these fill tubes and plunger rods that are mounted on pouch packaging machines. The plunger rods are located within hollow interiors of the fill tubes and include a bulbous valve thereon that allows for the control of the velocity of discharge of products from the fill tubes.

Because of technical advances in pouch forming and filling machines, more and more food products can be dispensed in product pouches as opposed to dispensing in more conventional cans and bottles. Certain products, however, are very difficult to package in pouches. These includes very thin liquids whose viscosity borders on that of water and solid component containing soups and sauces.

The fill tubes on many prior pouch packaging machines are nothing more than hollow tubes having an open end. A feed pump mechanism controls the flow and the amount of product introduced into the fill tube. A metered amount of product is injected in one end of the tube and this displaces a like amount of product from the other end. While this type of tube is useful for certain products having medium viscosity, as for instance catsup and salad dressing, it is totally unsuitable for very thin "runny" type products. For a very thin liquid, as for instance a liquid of a viscosity of about 40 to 50 centipoise, if a very narrow, small diameter fill tube is utilized the product remains in the tube because of surface tension and thus can be controlled via a cycling metering pump. However, because the tube is very narrow, fill rates are very slow. If, to increase the fill rate, a larger diameter tube is utilized, sometimes the surface tension between the liquid product and the fill tube is not sufficient to retain the contents of the fill tube between cycles of the metering pump. In two adjacent pouches one pouch may receive the correct amount of product but its adjacent pouch is over filled because, not only is the metered aliquot of product discharged as the pump cycles, but the total contents of the fill tube are also discharged into the pouch because of loss of surface tension between the product and the fill tube.

Quite contrary to a thin, runny product, it has also been very difficult to package products having particulate matter therein, as for instance soups and sauces, like oriental sauces. Because these products have large pieces of solid product in them, large tubes must be used. This prevents the use of an open end fill tube. Prior attempts to incorporate a valving mechanism on the end of a large fill tube have been less than satisfactory. Such prior attempts to utilized valving mechanisms generally resulted in inappropriate comminution of the solid part of the product by the valving mechanism. A consumer would find a pouch of water chestnuts very unappetizing if, in fact, all the water chestnuts have been shredded by the valving mechanism utilized to control the filling of a pouch with this product.

BRIEF DESCRIPTION OF THE INVENTION

It is a broad object of this invention to provide for fill tubes and plunger rods and assemblies for these fill tubes and plunger rods that can be utilized to dispense a wide variety of products on form, fill and seal pouch packaging machines. It is a further object to provide for fill tube and plunger rod assemblies that can be utilized with both very low viscosity products or with products containing particulate matter therein.

In accordance with these and other objects as will become evident from the remainder of this specification, the invention provides a tube and plunger rod for a pouch packaging machine wherein the fill tube has a hollow interior having a product inlet orifice, a product discharge orifice and a fill rod orifice connecting to the hollow interior. The plunger rod has first and second ends and is slidably mounted in the fill rod by insertion through the fill rod orifice. As so mounted a portion of the plunger rod including a first end of the plunger rod is located within the hollow interior of the fill tube with the remaining portion of the plunger rod extending out of the fill rod orifice and exterior of the fill tube. The first end of the plunger rod is capable of reversibly sealing against the product discharge orifice within the hollow interior of the fill tube to close the product discharge orifice and then be retracted to a position within the hollow interior away from the product discharge orifice to open the product discharge orifice. The plunger rod has a valve member on its first end. The valve member has a bulbous like shape that is formed as a surface of revolution and is sized to fit into and seal against the inside of the discharge orifice.

In a preferred embodiment of the invention the hollow interior of the fill tube has an expanded chamber and a product passageway. The product discharge orifice directly connects to the chamber and the product inlet orifice directly connects to the product passageway. The product passageway then connects between the product inlet orifice and the chamber. The width of the chamber is greater than either the width of the product passageway orifice or the width of the discharge orifice. The walls of the chamber taper into the discharge orifice. The valve member is sized and shaped to fit snugly into the discharge orifice but be pulled up into the chamber and spaced away from the chamber wall to open the discharge orifice.

The valve member can include a sealing surface thereon that is formed of a resilient but flexible material that is capable of sealing either against the discharge orifice or concurrently against the discharge orifice and any impediment, as for instance a bit of product, trapped between the discharge orifice and the valve member. Preferably the bulbous like shape of the valve member is a tear drop like shape.

The invention further provides a fill tube assembly for a pouch packaging machine that includes a housing, a prime member for producing motion located on the housing and a moving member operatively associated with the prime member so as to be reciprocally moved on the housing. This is coupled with a plurality of fill tubes and plunger rods as described above. Each of the fill tubes is operatively connected to the moving member and moved by the moving member. The connection between the plunger rods and the moving member is a rigid connection with respect to movement in a first direction. With respect to movement in the second direction, the connection for each of the individual plunger rods is a connection that is individually flexible for each individual plunger rod.

The connecting means of the assembly can include a plurality of adjustable rigid connectors equal in number to the number of the plunger rods and a like plurality of adjustable, compressible connectors. Each of the individual plunger rods is connected to the moving member via one of the rigid connectors and via one of the compressible connectors. With respect to movement in a first direction, the adjustable rigid connector connects the plunger rod to the moving member such that the plunger rods move in unison with the moving member in the first direction. With respect to movement in the opposite direction the compressible connectors flexibly connect the plunger rods to the moving member. As so connected if an individual plunger rod is impeded from moving in the opposite direction by an impediment, the moving member moves against the plunger rod's respective compressible connector and compresses that connector creating a biasing force in that compressible connector. The biasing force is then transferred to the respective plunger rod to bias movement of the plunger rod against the impediment. If a plunger rod is not impeded from moving in the opposite direction, the moving member moves the respective plunger rod's compressible connector and in turn that compressible connector moves the plunger rod in the opposite direction.

In a preferred embodiment of the invention the connector means includes the moving member having a plurality of openings with the number of the openings equal to the number of the plunger rods. The connector means further includes a plurality of first retainer means also equal in number to the number of plunger rods, a plurality of second retainers and a like plurality of compression springs all equal in number to the number of the plunger rods. Each of the plunger rods is located in one of the openings in the moving member with the second end of a plunger rod positioned on the opposite side of the moving member from the remainder of the respective plunger rods. One of the first retainers is located on that portion of the respective plunger that is positioned on the opposite side of the moving member. One of the second retainers is located on that portion of the respective plunger rod that is positioned between a respective fill tube and the moving member and one of the compression springs is positioned around a respective one of the plunger rods between the respective second retainer and the moving member.

BRIEF DESCRIPTION OF THE DRAWINGS

This invention will be better understood when taken in conjunction with the drawings wherein:

FIG. 3 is an enlarged elevational view in section about line 3—3 of FIG. 2;

FIG. 4 is a view similar to a portion of FIG. 3, however one of the components of FIG. 3 is shown in a different orientation in FIG. 4 compared to FIG. 3.

This invention utilizes certain principles and/or concepts as are set forth in the claims appended to this specification. Those skilled in the packaging arts will realize that these principles and/or concepts are capable of being utilized in a variety of embodiments that may differ from the embodiment utilized for illustrative purposes herein. For this reason this invention is not to be construed as being limited solely to the illustrative embodiments, but should only be construed in view of the appended claims.

DETAILED DESCRIPTION OF THE INVENTION

Form, fill and seal pouch packaging machines are finding greater use in packaging food stuffs. Typical of form, fill and seal pouch packaging machines for packaging food items are U.S. Pat. Nos. 4,768,330, 4,769,974 and 4,845,926, all of which are assigned to the assignee as this invention. The disclosures of these patents are herein incorporated by reference with respect to features of form, fill and seal pouch packaging machines. A typical flow control mechanism for product discharge of known form, fill and seal packaging machines is described in the above noted U.S. Pat. No. 4,769,974.

Normally in forming pouches on form, fill and seal pouch packaging machines, side seals are initially formed followed by a bottom cross seal. Product is then discharged into the partially formed pouch via a fill head or fill tube followed by formation of the top seal to complete the pouch.

Figure 1:
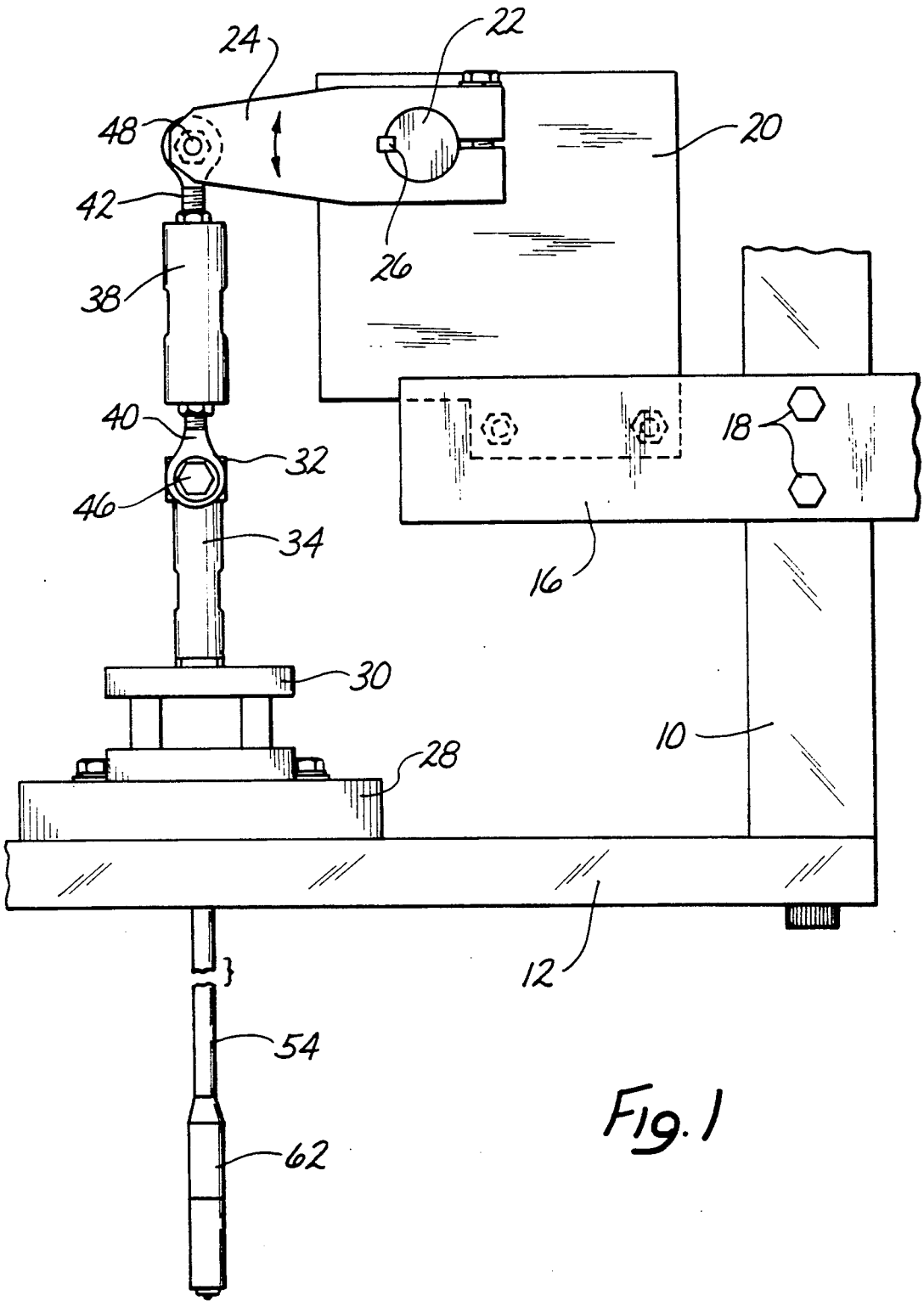
FIG. 1 is a side elevational view of portions of a pouch packaging machine containing a fill rod assembly of the invention thereon.
Figures 2, 5:
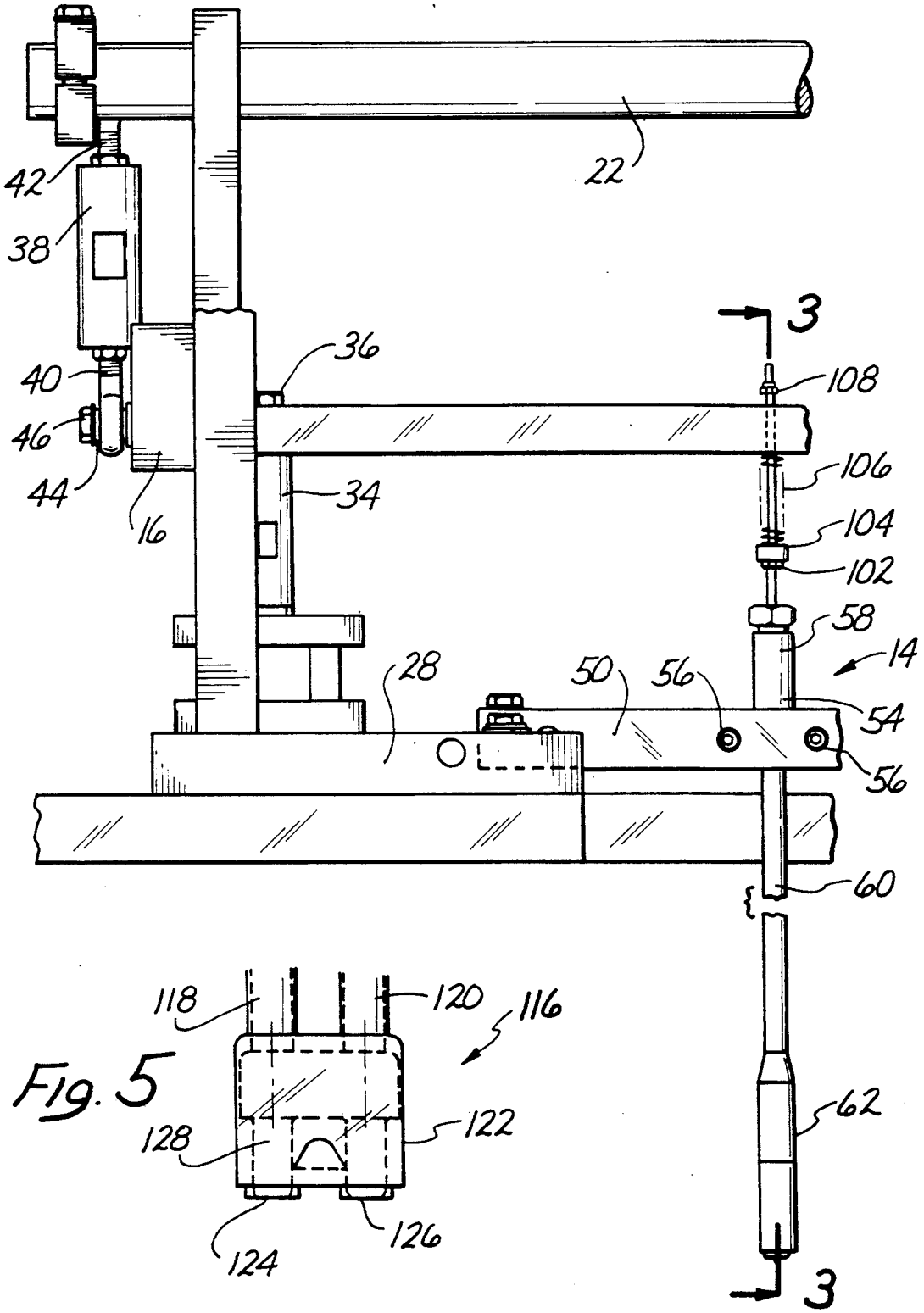
FIG. 2 is a front elevational view of a fragment of the pouch packaging machine and fill tube assembly of FIG. 1.
FIG. 5 is an alternate embodiment of a discharge end of a fill tube of the invention.

This invention is directed to fill tubes and associated plunger rods and mechanism associated with said fill tubes and plunger rods that are used on a form, fill and seal pouch packaging machine. For clarity of understanding of this specification and its drawings, only those parts of the form, fill and seal packing machine necessary to the understanding of the invention are shown in the figures and described in the specification. Those portion of a form, fill and seal pouch packaging machine shown FIGS. 1 and 2 are located in association with the area of the machine wherein product is added to partially formed pouches just prior to forming the top seal thereon. The components of FIGS. 1 and 2 would be located downstream from the side seal mechanism and upstream from the cross seal mechanism.

Shown in FIGS. 1 and 2 is a vertical support member 10 and a horizontal support member 12 that are formed as part of the housing of the form, fill and seal pouch packaging machine. The horizontal support member 12 extends across the width of the pouch packaging machine and components identical to those seen in FIGS. 1 and 2 would be located on the opposite side of the pouch packaging machine.

Normally the fill tube and plunger assemblies of the invention would be utilized on form, fill and seal pouch packaging machines of the type wherein a plurality of side by side pouches are formed on the machine, as for instance any where from two to a dozen or more depending upon the width of the machine. For illustrative purposes herein, only one fill tube assembly 14 is illustrated in the figures. For use on a form, fill and seal pouch packaging machine, a plurality of fill tube assemblies identical to the assembly 14 would be located across the width of the form, fill and seal pouch packaging machine. Each fill tube assembly 14 would be utilized to fill a single pouch or, as is shown in FIG. 5, several tube assemblies can be used in conjunction with each other and a common fill head to fill a larger pouch.

FIGS. 1 and 2 illustrate the left hand side of the fill tube area of a form, fill and seal pouch packaging machine. An identical set of components as described with respect to FIGS. 1 and 2 would be located on the right hand side of the form, fill and seal pouch packaging machine. For brevity of both the drawings and of this specification, while only the components on the left hand side of the machine are described, it is to be understood that complementary components exist on the right hand side that are identical (except for their left handedness or their right handedness) to those seen in FIGS. 1 and 2 and, as explained above, a plurality of fill tube assemblies 14 are located in a line between the left hand components as seen in FIG. 1 and FIG. 2 and the mirror image right hand side components.

A cross member 16 is attached to the vertical support member 10 via bolts collectively identified by the numeral 18. Extending upwardly from the cross member 16 is a stabilizer shaft bracket 20. A stabilizer shaft 22 is journaled in the shaft bracket 20 (and an identical right hand sided stabilizer shaft bracket). A stabilizer lever 24 is keyed via slot key 26 to the stabilizer shaft 22.

An adjustment plate 28 is bolted to the horizontal support member 12. An air cylinder 30 is fixed to the adjustment plate 28. The air cylinder 30 is a typical air activated cylinder, as for instance one having a two inch bore and a one inch stroke.

Plunger rod rack 32, i.e. a moving member, is horizontally positioned upwardly from the horizontal support member 12 and depressed with respect to the stabilizer shaft 22. An air cylinder spacer 34 is fixed to the air cylinder 30. The plunger rod rack 32 is attached to the air cylinder spacer 34 via a bolt 36. An adjusting sleeve 38 includes a lower adjusting arm 40 and an upper adjusting arm 42. The lower arm 40 has a built in bearing 44. A bolt 46 connects the plunger rod rack 32 to the lower arm 40. Upper arm 42 includes a bearing (not separately numbered or identified but identical to bearing 44). A bolt 48 connects this bearing and thus the upper arm 42 to the stabilizer lever 24.

As noted above, a mirror image right side exists with respect to certain of the components of FIGS. 1 and 2. These would include the adjusting plate 28, the air cylinder 30, the air cylinder spacer 34, the attaching bolt 36, the adjusting sleeve 38 and its upper and lower arms 40 and 42 and their bearings, bearing 44 and the un-numbered bearing on arm 42, the stabilizer lever 24, key 26 and stabilizer shaft bracket 20. As such each side of the fill tube assemblies, as illustrated in FIGS. 1 and 2, would be powered by an independent air cylinder.

The plunger rod rack 32 is attached at one of its ends, i.e. the left end as seen in FIG. 2, to the air cylinder spacer 34 and would be attached in a similar manner about the other of its ends to a right side component. Movement of the two sides of the plunger rod rack 32 is coordinated via the stabilizer shaft 22. Insofar as each end of the plunger rod rack 32 is attached to an adjusting sleeve and these sleeves in turn are attached to stabilizer levers that are keyed to the stabilizer shaft 22, movement of one side of the device is transferred via the adjusting sleeves and the stabilizing lever 24 to the stabilizing shaft 22. The presence of the stabilizing shaft 22 thus ensures that reciprocal movement of the plunger rod rack 32 on the form, fill and seal pouch packaging machine is coordinated as to its ends even though independent air cylinders are utilized to drive the opposite ends. The use of independent air cylinders to drive the opposite ends assures that all of the individual fill tube assemblies 14 across the totality of the width of the plunger rod rack 32 are driven with the same force through the same stroke.

An elongated fill tube rack 50 fits onto a step shoulder 52 on the adjusting plate 28 (and on its other end on the unseen similar right side adjusting plate). Each fill tube assembly 14 has a fill tube 54 that is attached to the fill tube rack 50 via bolts 56 and an unseen bracket on the back side of the fill tube rack 50.

The fill tube 54 about a cylindrical portion 58 is of a larger outside diameter than it is about a further cylindrical portion 60. The top of the portion 60 is press fitted into an appropriate bore in the bottom of portion 58 as is seen in FIG. 3. Referring now concurrently to FIGS. 2 and 3, the lower end of the fill tube 54 has an outward flare about a further cylindrical portion 62. As is hereinafter explained this allows for an increase in the interior diameter of the fill tube 54 about the portion 62.

As is evident from FIG. 3, the upper end of the fill tube 54 includes a fill rod orifice 64 and a product inlet orifice 66. A tube 68 for conveying product to the product inlet orifice 66 is attached to the product inlet orifice 66.

A product passageway 70 extends downwardly from the product inlet orifice 66 throughout the cylindrical area 60 to the cylindrical area 62. Within the cylindrical area 62 a chamber 72 is formed. The chamber is of a wider diameter than the passageway, i.e. it is flared with respect to the passageway 70. The lower end of the chamber 72 includes a tapered conical wall 74 that terminates at a product discharge orifice 76. The diameter about the product discharge orifice 76 is smaller than the diameter about the interior of the chamber 72. The effect of this will be evident after discussing other components of the fill tube assembly 14.

A plunger rod 78 has a lower end 80 and an upper end 82. The plunger rod 78 is positioned in the fill rod orifice and is sealed to the fill tube 54 via a compression nut 84. A bore 86 is tapped into the top of the cylindrical area 58 of the fill tube 54. The compression nut 84 screws into the bore 86 against an O-ring 88. This seals the compression nut 84 to the fill tube 54. An upper O-ring chamber 90 and a lower O-ring chamber 92 are machined into the inside of a bore 94 traversing through the compression nut 84. An upper O-ring 96 and a lower O-ring 98 fit into the upper and lower O-ring chambers 90 and 92 for sealing the compression nut 84 to the plunger rod 78 while still allowing for movement of the plunger rod 78 with respect to the compression nut 84.

The upper end 82 of the plunger rod 78 is threaded. This threaded end passes through a bore 100 formed in the plunger rod rack 32. As was stated above, a plurality of fill tube assemblies 14 would be utilized. As such a plurality of bores identical to bore 100 would be formed in the plunger rod rack 32, one of these bores for each of the fill tube assembles 14 that are utilized.

The threads on the upper end of the plunger rod 78 extend downwardly along a sufficient length of the plunger rod 78 allowing for positioning of a lower retaining nut 102 below the plunger rod rack 32, but spaced upwardly from the compression nut 84. A spring seat washer 104 rests on the nut 102. A compression spring 106 is positioned on the spring seat washer 104 below the plunger rod rack 32. An upper retaining nut 108 then fixes the plunger rod 78 to the plunger rod rack 32.

The lower end 80 of the plunger rod 78 has a bulbous shaped valve 110 located thereon. The valve 110 is essentially tear drop in shape. As is evident from FIG. 4, it is formed by locating a material 112 around a cap 114 that, in turn, is located on the lowermost end of the plunger rod 78. The material 112 forms a sealing surface on the valve 110 of the plunger rod 78. Preferably the material 112 is a resilient but still deformable material, i.e. still flexible material, as for instance a material sold under the tradename of Vitron by the DuPont Company. This material has excellent abrasion strength, but is flexible enough such that when the valve 110 is pushed into the product discharge orifice 76, a tight seal is formed between the valve 110 and the orifice 76, Yet if an impediment, as for instance a small food particle or the like, were to be lodged or caught between the valve 110 and the orifice 76, the material 112 would flex sufficiently to seal around both that particle of material and the remainder of the product discharge orifice 76.

As seen in FIG. 3, the valve 110 is seated in the product discharge orifice 76 to seal the same. When the valve 110 is withdrawn up into the body or the hollow interior of the fill tube 54, the valve 110 becomes positioned within the chamber 72 of the fill tube 54. To close the fill tube 54, the plunger rod 78 is depressed downwardly within the fill tube 54 to seat the valve 110 into the product discharge orifice 76.

In operation, activation of the air cylinder 30 (as well as its identical right side air cylinder) lifts the plunger rod rack 32 upwardly. The upper retaining nut 108 comprises an adjustable but rigid connector. It can be positioned along the length of the threads on the plunger rod 78 but once positioned, it is rigid. Thus, while in one aspect it is adjustable, in a further aspect when the plunger rod rack 32 moves upwardly and contacts the nut 108, it is essentially fixed to the plunger rod 78. Upward movement of the plunger rod rack 32 can therefore be directly transferred to the plunger rod 78 lifting the same to lift the valve 110 upwardly into the chamber 72 away from the product discharge orifice 76.

Movement of the plunger rod rack 32 in the opposite direction, that is downwardly, is slightly different. In moving down the plunger rod rack 32 contacts the compression spring. The compression spring comprises a flexible connecting member between the plunger rod 78 and the plunger rod rack 32. If nothing is impeding the valve 110 against downward movement, when the plunger rod rack 32 contacts the compression spring 106, force applied to the compression spring 106 is transmitted to the washer 104 and to the nut 102. The nut 102, while being adjustable along the plunger rod rack 78, after adjustment, is fixed in position. Force propagated to it is therefore directly transferred to the plunger rod 78 moving it downwardly. If, however, something is positioned between the valve 110 and the product discharge orifice 76 inhibiting downward movement of the plunger rod 78, downward movement of the plunger rod rack 32 against the compression spring 106 compresses the spring 106 introducing a bias force therein. This bias force is transmitted via the washer 104 and the nut 102 to the plunger rod 78 urging it downward.

When a series of fill tube assemblies 14 are aligned along the fill tube rack 50, the presence of the flexible connection as exemplified by the compression spring 106 allows for differential movement between the individual plunger rods of the various fill tube assemblies 14 along the width of the form, fill and seal packaging machine. Thus, if a food particle is impeding the complete downward displacement of one of the plunger rods 76, the flexibility between that plunger rod and the plunger rod rack 32 allows for the other plunger rod racks to be fully depressed and sealed against their product discharge orifice while still accommodating the slight resistance of the particular plunger rod that has an impediment between its valve 110 and its product discharge orifice 76.

Further when multiple assemblies of fill tubes and plunger rods of the invention are located on a form, fill and seal pouch packaging machine, the nuts 102 can be positioned on the plunger rods 78 such that a slight bias is introduced into the compression spring of each individual fill tube and plunger rod assembly when the valves 110 on the individual plunger rods seat in their respective product discharge orifice 76. This results in a continuous positive closure of each and every discharge orifice 76 without having to make individual "micro" adjustments, either initially or continuously to compensate for wear over the life time of the plunger rods, of the position of the plunger rods 78 on the plunger rod rack 32.

The fill tube assemblies 14 of the invention can be used in conjunction with very thin, low viscosity liquids, intermediate viscosity products or even products having particulate matter therein, as for instance soups, sauces and the like. The deformable material 112 on the surface of the valve 110 allows for forming a seal with the product discharge orifice 76 even when very thin or low viscosity liquids are being packaged. Further, the flexibility in the material 112 on the valve 110 allows for passage of solid components and, if one of those solid components happens to be caught within the product discharge orifice 76 as the valve 110 is closed, it accommodates any residual part of that solid particle by flexing inwardly to seal to that particle while still maintaining its seal with the other portions of the product discharge orifice 76.

The fill tube assemblies 14 would be utilized in conjunction with a positive displacement pump for supplying product via the product inlet orifice 66 and the tube 68. Such a displacement pump would be utilized to meter and force a particular aliquot of product into the fill tube 54. Displacement of the product into the fill tube 54 is coordinated with upward movement of the plunger rod 76. After the product has been discharged from the product discharge orifice 76, however, the movement of the plunger rod 76 downwardly to engage the valve 110 in the product discharge orifice 76 would prevent thin "runny" product that is still located within the fill tube 54 for moving downwardly under the influence of gravity and over filling a pouch that is being formed and filled on the form, fill and seal pouch packaging machine.

By forming the chamber 72 of a dimension greater than either the product passageway 70 or product discharge orifice 76 and just upstream from the product discharge orifice 76, product moving through the chamber 72 will be moving at a slower velocity than product moving through the discharge orifice 76. Thus, product moving through the discharge orifice 76 is moving at an accelerated velocity compared to product just behind it. This tends to render the fill tube assembly 14 self cleaning. As the valve member 110 closes into the product discharge orifice 76, its cross sectional area becomes smaller and smaller and the velocity of the product being discharged therefrom increases to higher and higher values. Thus, the last little bit of product that is discharged from the fill tube assembly 14, just before the valve 110 seats in the discharge orifice 76, is moving at a very high velocity and thus moves away from the fill tube assembly 14 leaving the discharge orifice 76 clean.

Further, because the chamber 72 is of a greater diameter than the discharge orifice 76, when the valve 110 retracts into the chamber 72, there is sufficient clearance between the inside wall of the chamber and the outside of the valve 110 to allow for passage of solid particulate matter passed the valve 110 without the particulate matter plugging up the fill tube or the valve 110 unduly breaking up the particles of the particulate matter. Again, because the chamber 72 is of a wider dimension than the product passage 70, as the material flows around the valve 110 between it and the inside of the chamber 72, its velocity increase as the product crosses over the surface of the valve 110. This, in turn, also helps to keep material flowing through the inside of the fill tube 54.

The tear drop shape of the valve 110 assists in smooth laminar flow of product past it, especially when there is particulate matter in that product. As was discussed above, as the valve 110 approaches the product discharge orifice 76, the product starts flowing faster and faster as the space between the valve 110 and the discharge orifice 76 narrows. The tear drop shape causes smooth flow of the product across the surface of the valve 110 and within the conical wall 74. This is contrasted to uneven turbulent flow that would occur if a mushroom shaped head (i.e. a valve very similar to an automobile exhaust valve) were utilized to close the discharge orifice 76.

When thin, low viscosity or "runny" products are being utilized on a form, fill and seal pouch packaging machine, generally the pressure these products are subjected to in passing through the fill tube assemblies can be lower than when more viscous material is being utilized. With viscous material, higher pressures and thus higher velocities through the fill tube assemblies 14 serve to keep the fill tube assemblies 14 self cleaning irrespective of the fact that a viscosity material is being ejected from these assemblies. Because of this, even with very viscous material or particulate matter products, external product cut-off knifes or wires are not needed.

In FIG. 5 a further embodiment of the invention is illustrated. In FIG. 5 the discharge end 116 of a fill tube assemblies is illustrated. Two fill tubes, 118 and 120 are joined in a spreader 122. Each of the fill tubes 118 and 120 include a plunger rod equivalent to the plunger rod 78.

Two discharge orifices 124 and 126 are formed in the spreader 122. A common interior chamber 128 is formed between the tubes 118 and 120 and the orifices 124 and 126. The discharge orifices 124 and 126 are individually controlled by their own individual plunger rods, however, normally they are activated simultaneously. The fill tube assembly of FIG. 5 is normally utilized in wider bags or larger bags that hold a larger volume of product. Indeed gangs of assemblies similar to that of the discharge end 116 illustrated in FIG. 5 can be located side by side for very wide bags.

The use of the common reservoir 128 allows product to be added to the device of FIG. 5 either through one or the other of both of the fill tubes 118 or 120, preferably both and discharged concurrently from the orifices 124 and 126.

I claim:

1. A fill tube and plunger for a pouch packaging machine comprising:

a fill tube having a hollow interior;

said fill tube having a product inlet orifice, a product discharge orifice and a fill rod orifice connecting to said hollow interior;

the hollow interior of said fill tube having a chamber and a product passageway, said product discharge orifice directly connecting to said chamber, said product inlet orifice directly connecting to said product passageway with said passageway leading between said product inlet orifice and said chamber;

the width of said chamber being greater than the width of said product passageway;

a plunger rod having first and second ends;

said plunger rod slidably mounted through said fill rod orifice such that a portion of said plunger rod including said first end of said plunger rod is located within said hollow interior of said fill tube and the remaining portion of said plunger rod extends out of said fill rod orifice and is exterior of said fill tube with said first end of said plunger rod sealing against said product discharge orifice within the hollow interior of said fill tube to close said product discharge orifice and retracting within said hollow interior away from said product discharge orifice to open said product discharge orifice; and said plunger rod having a valve member on its first end, said valve member having a bulbous like shape that is formed as a surface of revolution and is sized to fit into and seal to the inside of said discharge orifice.

2. A fill tube and plunger of claim 1 wherein:

said discharge orifice is of a width less than the width of said chamber and including a conical wall tapering down in width from said chamber to said discharge orifice.

3. A fill tube and plunger of claim 1 wherein:

said valve member has a sealing surface, said sealing surface formed of a resilient deformable material capable of sealing either against said discharge orifice or concurrently against said discharge orifice and an impediment located between said discharge orifice and said valve member.

4. A fill tube and plunger of claim 1 wherein:

said bulbous like shape of said valve member is a tear drop like shape.

5. A fill tube and plunger for a pouch packaging machine comprising:

a fill tube having a hollow interior;

said fill tube having a product inlet orifice, a product discharge orifice and a fill rod orifice connecting to said hollow interior;

a plunger rod having first and second ends;

said plunger rod slidably mounted through said fill rod orifice such that a portion of said plunger rod including said first end of said plunger rod is located within said hollow interior of said fill tube and the remaining portion of said plunger rod extends out of said fill rod orifice and is exterior of said fill tube;

the hollow interior of said fill tube having a chamber and a product passageway, said product discharge orifice directly connecting to said chamber, said product inlet orifice directly connecting to said product passageway with said passageway leading between said product inlet orifice and said chamber, the width of said chamber being greater than the width of said product passageway and the width of said discharge orifice being less that the width of said chamber;

said plunger rod having a valve member on its first end, said valve member having a tear drop like shape that is sized and shaped to fit into and seal to the inside of said discharge orifice to close said discharge orifice and to retract into said chamber to open said product discharge orifice; and said valve member having a sealing surface, said sealing surface formed of a resilient deformable material capable of sealing either against said discharge orifice or concurrently against said discharge orifice and an impediment located between said discharge orifice and said valve member.

6. A fill tube assembly for a pouch packaging machine comprising:

a housing;

prime mover means for producing motion;

a moving member operatively associated with said prime mover so as to be reciprocally moved on said housing by said prime mover;

a plurality of fill tubes each having a hollow interior, said fill tubes fixedly mounted on said housing;

each of said fill tubes having a product inlet orifice, a product discharge orifice and a fill rod orifice connecting to said hollow interior;

a plurality of elongated plunger rods having first and second ends, the number of said plunger rods equal in number to the number of said fill tubes;

each of said fill tubes having one of said plunger rods slidably mounted through its fill rod orifice such that for each fill tube and associated plunger rod a portion of said plunger rod including said first end of said plunger rod is located within said hollow interior of said fill tube and the remaining portion of said plunger rod extends out of said fill rod orifice and is exterior of said fill tube with said first end of said plunger rod sealing against said product discharge orifice within the hollow interior of said fill tube to close said product discharge orifice and retracting within said hollow interior away from said product discharge orifice to open said product discharge orifice; and connecting means on said second end of said plunger rods for rigidly connecting said plunger rods to said moving member with respect to movement in a first direction and individually flexibly connecting said plunger rods to said moving member with respect to movement in the opposite direction.

7. A fill tube assembly of claim 6 wherein:

each of said fill tubes is an elongated tube having said product discharge orifice at one end thereof, said fill rod orifice at the other end and said product inlet orifice intermediate said product outlet orifice and said fill rod orifice.

8. A fill tube assembly of claim 7 wherein:

said product inlet orifice is proximal said fill rod orifice.

9. A fill tube assembly of claim 6 wherein:

said connecting means includes a plurality of adjustable rigid connectors equal in number to the number of said plunger rods and a like plurality of adjustable compressible connectors, each of said respective plunger rods being connected to said moving member via a respective one of said rigid connectors and a respective one of said compressible connectors.

10. A fill tube assembly of claim 9 wherein:

with respect to movement in a first direction said adjustable rigid connectors connecting said plunger rods to said moving member such that said plunger rods move in unison with said moving member in said first direction; and with respect to movement in the opposite direction said compressible connectors flexibly connecting said plunger rods to said moving member such that if an individual plunger rod is impeded from moving in said opposite direction by an impediment said moving member moves against said plunger rod's respective compressible connector and compresses that connector creating a biasing force in that compressible connector with said biasing force then being transferred to the respective plunger rod to bias movement of said plunger rod against the impediment, and if a respective plunger rod is not impeded from moving in said opposite direction said moving member moving the respective plunger rod's compressible connector and in turn the compressible connector moving the plunger rod in said opposite direction.

11. A fill tube assembly of claim 6 wherein:

said connecting means includes said moving member having a plurality of openings located therein, the number of said openings equal in number to the number of said plunger rods;

said connecting means further including a plurality of first retainers equal in number to the number of said plunger rods, a like plurality of second retainers and a like plurality of compression springs;

each of said plunger rods is located in one of said openings in said moving member with the second end of the respective plunger rods positioned on the opposite side of said moving member from the remainder of said respective plunger rod;

one of said first retainers is located on that portion of a respective plunger rod that is positioned on said opposite side of said moving member;

one of said second retainers is located on that portion of a respective plunger rod that is positioned between a respective fill tube and said moving member; and one of said compression springs is positioned around a respective one of said plunger rods between the respective second retainer located on said respective plunger rod and said moving member.

12. A fill tube assembly of claim 6 wherein:

said prime moving means includes two prime movers;

said moving member comprising an elongated member having ends;

one of said prime movers connected proximal to one of said ends of said moving member and the other of said prime movers connected proximal to the other of said ends of said moving member; and stabilizing means for externally linking said ends of said moving member together.

13. A fill tube assembly of claim 12 wherein:

said stabilizing means includes an elongated stabilizing shaft having ends, first and second stabilizing levers and first and second adjustable sleeves;

said stabilizing shaft is journaled on said housing in parallel with said moving member so as to rotate on said housing;

said first of said stabilizer levers is mounted proximal to one of said ends of said stabilizer shaft and said second of said stabilizer levers is mounted proximal to the other of said ends of said stabilizer shaft; and said first adjustable sleeve is connected between first stabilizer lever and said one of the ends of said moving member and said second adjustable sleeve is connected between said second stabilizer lever and said other of the ends of said moving member.

14. A fill tube of claim 6 including:

said plunger rods each having a valve member on their ends; and said valve members each including a sealing surface, said sealing surface formed of a resilient deformable material capable of sealing either against said discharge orifices or concurrently against said discharge orifices and an impediment located between said discharge orifice and said valve member.

15. A fill tube of claim 6 including:

said plunger rods each having a valve member on their ends, said valve members each having a bulbous like shape that is formed as a surface of revolution.

16. A fill tube of claim 15 wherein:

said bulbous like shape of said valve member is sized to fit into and seal to the inside of said discharge orifice.

17. A fill tube of claim 15 wherein:

said bulbous like shape of said valve member is a tear drop like shape.

18. A fill tube of claim 6 including:

the hollow interior of each of said fill tubes having a chamber and a product passageway, said product discharge orifice directly connecting to said chamber, said product inlet orifice directly connecting to said product passageway with said passageway leading between said product inlet orifice and said chamber; and the width of said chamber being greater than the width of said product passageway.

19. A fill tube of claim 18 including:

said discharge orifice being of a width less than the width of said chamber and including a conical wall tapering down in width from chamber to said discharge orifice; and said plunger rods each having a valve member on their ends, said valve members each having a bulbous like shape that is formed as a surface of revolution and is sized to fit into and seal to the inside of said discharge orifice.

20. A fill tube of claim 19 wherein:

said valve members each including a sealing surface, said sealing surface formed of a resilient deformable material capable of sealing either against said discharge orifices or concurrently against said discharge orifices and an impediment located between said discharge orifice and said valve member.

* * * * *